US005923249A

United States Patent [19]

Muir

[11] Patent Number: 5,923,249

[45] Date of Patent: Jul. 13, 1999

[54] DOOR SECURITY SYSTEM

[75] Inventor: Robert Linley Muir, Neutral Bay, Australia

[73] Assignee: Aristocrat Leisure Industries Pty. Ltd., Rosebery, Australia

[21] Appl. No.: 08/860,892

[22] PCT Filed: Jan. 11, 1996

[86] PCT No.: PCT/AU96/00012

§ 371 Date: Jul. 11, 1997

§ 102(e) Date: Jul. 11, 1997

[87] PCT Pub. No.: WO96/21916

PCT Pub. Date: Jul. 18, 1996

[30] Foreign Application Priority Data

Jan. 11, 1995 [AU] Australia ..... PN0491

[51] Int. Cl.[6] ..... G08B 13/08

[52] U.S. Cl. ..... 340/545; 273/138.1; 340/508; 340/693; 463/29; 463/47

[58] Field of Search ..... 340/545, 693, 340/508; 273/138.1; 463/29, 47, 16

[56] References Cited

U.S. PATENT DOCUMENTS 4,117,465 9/1978 Timblin ..... 340/545

4,427,975 1/1984 Kinzie ..... 340/693

4,977,392 12/1990 Loda ..... 340/545

5,097,253 3/1992 Eschbach et al. ..... 340/545

*Primary Examiner*—Glen Swann

*Attorney, Agent, or Firm*—Friedman Siegelbaum LLP

[57] ABSTRACT

An optional security system for monitoring door opening is designed to be plugged into the main board of a slot machine without any change of hardware or addition of extra switches. This security system allows time stamping of any access to the machine interior and will operate while the machine is powered down. Standard and optional security is designed so that when the optional security module is added it can share the same sensors as the standard system. The normal security system does not prevent the security module functioning when the power is off. Ideally, a security module can be plugged into a machine and take over or add the new security features. The isolation between the main board and the security system is achieved by the use of schottky diodes. When operating from battery power, the security subsystem remains in a low power drain "sleep" state for the majority of the time, "waking up" periodically to check the door switches and then going to sleep again.

17 Claims, 2 Drawing Sheets

DOOR SECURITY SYSTEM

INTRODUCTION

The present invention relates generally to gaming or slot machines and in particular to an improved door security system for use on such machines.

It is a common requirement for slot machines to include an electronic monitoring system to monitor door openings in a slot machine cabinet to prevent fraudulent tampering with the internal mechanisms or circuitry of the machine and to prevent theft of cash from internal cash storage areas. Such systems are generally effective while the slot machine remains powered up but there exists the possibility that such a system might be defeated if the machine were turned off or disconnected from mains power.

SUMMARY OF THE INVENTION

According to a first aspect, the present invention consists in a security system for monitoring door openings, the system comprising one or more door open detection devices, and first and second monitoring systems each connected to each of the one or more detection devices the second monitoring system being arranged with battery power supply means and the first monitoring system being arranged to allow the second monitoring system to continue operating when power to the first monitoring system is interrupted.

Preferably the two monitoring systems each supply power to each of the door open detection devices such that if power to one monitoring system is interrupted, power is still supplied by the other system without being loaded by the unpowered system preferably sharing is performed by a pair of sharing diodes.

In a preferred embodiment, the second monitoring system operates intermittently at regular intervals, when operating from batteries, in order to conserve battery power, and between monitoring operations returns to a low power mode to minimize battery drain.

In the preferred embodiment the second monitoring system also includes a real time clock whereby door openings are time stamped.

Preferably communication means are also provided between the second monitoring means and the first monitoring means whereby door openings detected while the first monitoring means is unpowered may be communicated to it upon reinstatement of power.

According to a second aspect, the present invention consists in a slot machine comprising game playing means and control means wherein the slot machine includes a security system as hereinbefore described.

BRIEF DESCRIPTION OF THE DRAWINGS

An embodiment of the invention will now be described, by way of example, with reference to the accompanying drawings in which.

DETAILED DESCRIPTION OF THE EMBODIMENT

Figure 1:
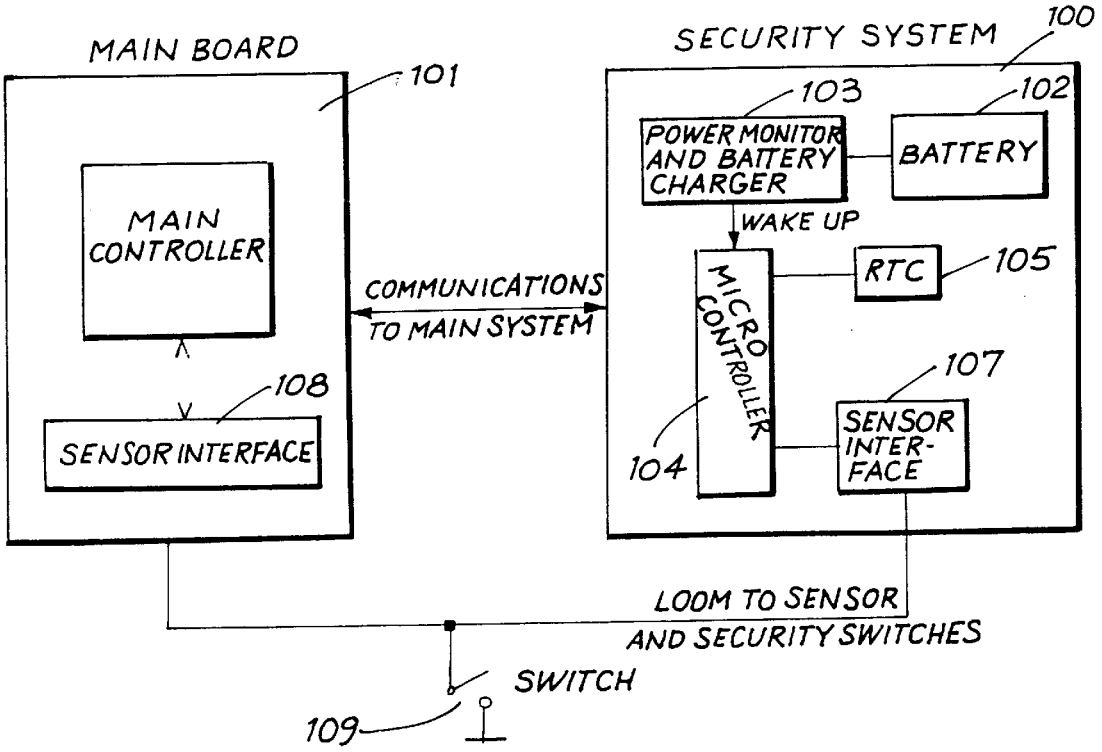
FIG. 1 schematically illustrates a security system according to an embodiment of the resent invention.

The preferred embodiment of the invention will be described with reference to a gaming machine.

Slot machines must comply with different rules and laws depending upon the jurisdiction in which they are operated. In many jurisdictions it is necessary that the machine be able to detect the opening of various parts of the cabinet and to respond appropriately to prevent fraudulent activities. In some jurisdictions it is a requirement that such access be detected even when the machine is powered down.

The opening of the following areas must be able to be checked to comply with the regulations of various jurisdictions:

1. Main door
2. Logic cages—main processor, meters, distributed logic, progressives
3. Cash-box door
4. Top-box door
5. Bill acceptor/stacker
6. Stacker
7. Mechanical meters
8. Hopper access
9. Printer access The sensing of the areas may be done optically or mechanically, however, the main door requires both mechanical and optical detections.

Also it is desirable to be able to accommodate the sensing of the above areas at all times, even when the mains voltage is not connected and report the time at which the opening has occurred.

It also desirable that the sensors used be unaffected by RF radiation around the machine in order that the machine is compatible with International electrical standards.

Referring to FIG. 1, an optional security system 100 is illustrated which is designed to be plugged into the main board 101 without any change of hardware or addition of extra switches. The optional security system 100 includes an emergency power supply comprising a battery 102 and power monitor/charger 103 which enables the system to operate when the main machine power supply is off. The security system 100 also includes a controller 104 and a time of day clock 105 as well as sensor interfaces 107 The sensor interfaces 107 are connected in parallel with sensor interfaces 108 of tie main board and share access to sensors 109. This security system allows time stamping of any access to the machine interior and will operate while the machine is powered down.

Figure 2:
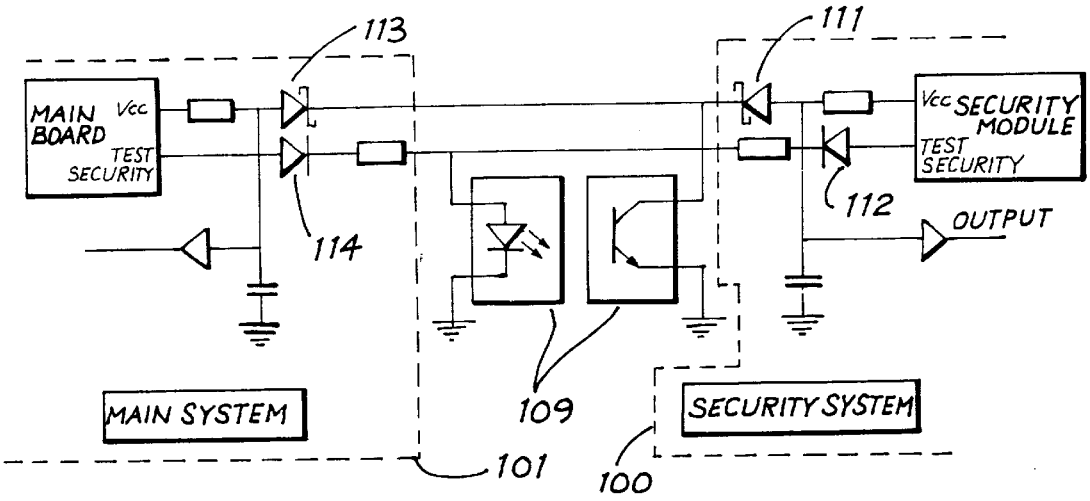
FIG. 2 schematically illustrates a detail of the of the sensor connection arrangement for photo-optic sensors connected to the system of FIG. 1.
Figure 3:
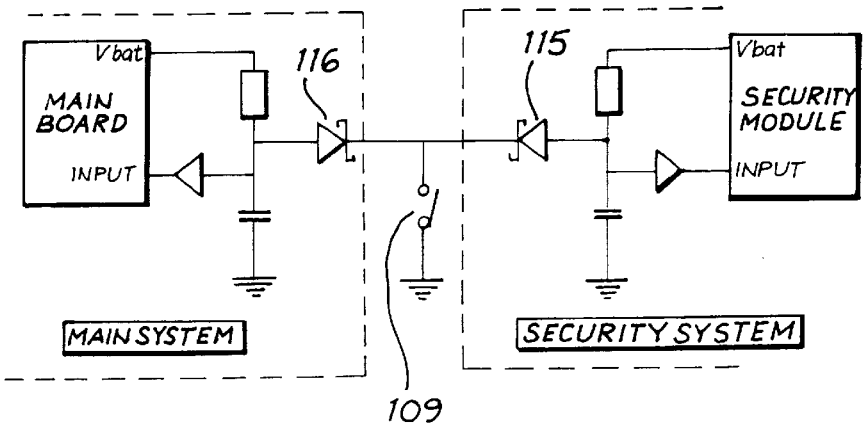
FIG. 3 schematically illustrates a detail of the sensor connection arrangement for microswitches connected as sensors in the system of FIG. 1.

FIGS. 2 and 3 define the interface by which the optional security system can "take over" the monitoring of door sensors by the use of diodes 111–116 optional security board 100 and the main board 101 to isolate both systems from one another.

The following table defines the type and use for each sensor:

| Sensor - Mechanical Switch | Sensor - Optic Switch |
|---|---|
| Main door switch | Main door opto - power on |
| Cash box door switch | Cashbox door opto |
| Topbox door switch | Top box door opto |
| Bill acceptor switch | |
| Stacker | |

Standard and optional security is designed so that when the security module is added it can share the same sensors. The normal security system does not prevent the security module functioning when the power is off. Ideally, a security module can be plugged into a machine and take over or add the new security features.

In both FIGS. 2 and 3, the isolation between the main board and the security system is achieved by the use of schottky diodes.

When operating from battery power, the security subsystem remains in a low power drain "sleep" state for the majority of the time, "waking up" periodically to check the door switches and then going to sleep again.

When the micro-controller wakes up, it pulses the supply lines to the optical sensors and microswitches and monitors of the input lines to determine if any doors are open. If any door is open it records the identity of the open door and the current time before going back to sleep. When power is restored to the slot machine the micro-controller communicates to the main processor or the controller of the slot machine the details (time and identity) of any doors opened while the machine was powered down.

If a door is opened while the slot machine is powered up, the security subsystem communicates the identity of the open door and the current time of day to the slot machine immediately.

The main board and the add on security board are able to accommodate two types of security sensors:

| Item | Type | Number Provided | Description |
|---|---|---|---|
| 1. | Optical sensors | 8 | IR LED and Phototransistor pair |
| 2 | Mechanical sensors | 8 | Low current micro switch |

The sensors are arranged to be shared between the detector circuits on the main board and the external optional add in module, known as the "Security Subsystem". The Security Subsystem has optical and mechanical security detection on normal operation and during power down, and also performs time stamping and logging of the security events.

The slot machine is able to detect when security has been broken during power off. by virtue of information provided by the Security Subsystem.

The security systems each provide the necessary circuitry to interface with 8 (eight photo-sensors.

The photo-sensors consist of an infrared LED emitting a light beam and a photo transistor, receiving the beam. Only the optosensors are distributed in the machine with the remainder of the interface circuit being located within the logic cage.

The optical interface circuitry has the following specification:

1. Emitters:

The current to the IR LED is 15 mA+/−20% the current is taken from the +5 Volts logic supply and referenced to +5 V logic and The circuit is filtered for EMC (0.1 microfarad ceramic capacitor)

The current is ON after reset

The emitters are referenced to the +5 Volt logic ground

The emitters an be turned ON/OFF under CPU control. This provides greater security by preventing disabling of the detector by shining a light (IR) into the detector and simply separating thee sensors. The emitter is normally pulsed ON/OFF and the detector should follow the emitter. Failure of the detector to follow the emitter causes an alarm condition.

The IR LED's can be driven from the Security Subsystem, even when the main machine power is off. The interface circuits on the main board do not prevent the Security Subsystem module from functioning when the power is off. This is achieved by supplying emitter current from two sources, the main board and the Security Subsystem through sharing diodes. Ideally a security module can be plugged into a machine and take over or add the new security features.

2. Receivers:

The output current from the photo-transistor is sensed via a 10 Kohms 5% resistor.

The current is taken from the +5 Volts logic supply

The circuit is filtered for EMC (0.1 microfarad, ceramic capacitor)

The signals are connected to an internal SPI channel via a 30 Hz low pass filter, and sensed with HCMOS logic levels The main board circuit does not prevent the Security Subsystem module from functioning when the power is off. This is achieved by supplying "pull up" voltage to each receiver from two sources, the main board and the Security Sub-system, through sharing diodes. Ideally a security module can tie plugged into a machine and take over or add the new security features. Diodes are included so the receiver call be shared.

The mechanical security systems each include 8 inputs to sense the state of low current microswitches.

The system is designed to operate with normally closed security switches as this is generally a requirement of regulatory authorities.

Four of the 8 microswitch inputs can operate with change over switches (i.e. nornmally open and normally closed in the same switch), as required by some regulatory authorities.

The microswitches are shared between the main board security system and tile Security Subsystem ill the same way that the optical sensors are shared.

The specification for the mechanical security sensor inputs are:

The current to each microswitch is 20 mA nominal when connected to +5 VCC and 3 microAmp when connected to the battery of the Security Subsystem The microswitch is normally closed The current is taken from the +5 Volts logic supply and is referenced to the logic ground The circuit is filtered for EMC (0.1 microfarad ceramic capacitor)

The signals are connected to an internal SPI channel via a 30 Hz low pass filter, and sensed with HCMOS logic levels.

The main board does not prevent the Security Subsystem module from functioning when the power is off. This is achieved by supplying the "pull up" voltage to each microswitch from two sources, the main board and the Security Subsystem through shorting diodes. Ideally a security module can be plugged into a machine and take over or add the new security features.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A security system for monitoring door openings, the system including one or more door open detection devices, and first and second monitoring systems each connected to each of the one or more detection devices the second monitoring system being arranged with battery power supply means and the first monitoring system being arranged to allow the second monitoring system to continue operating when power to the first monitoring system is interrupted.

2. The security system of claim 1 wherein the two monitoring systems each supply power to each of the door open detection devices such that if power to one monitoring system is interrupted, power is still supplied by the other system without being loaded by the unpowered system.

3. The security system of claim 2 wherein power to each of the door open detection devices is supplied from each of the monitoring systems via a pair of sharing diodes.

4. The security system of claim 3, wherein the second monitoring system is arranged to operate intermittently at regular intervals, when operating from batteries, and returns to a low power mode between monitoring operations.

5. The security system of claim 4, wherein the second monitoring system also includes a real time clock which operates continuously whereby door openings are time stamped.

6. The security system of claim 5, wherein communication means are also provided between the second monitoring means and the first monitoring means whereby information of door openings detected while the first monitoring means is unpowered may be communicated to it upon reinstatement of power.

7. The security system of claim 1, wherein the second monitoring system is arranged to operate intermittently at regular intervals, when operating from batteries, and returns to a low power mode between monitoring operations.

8. The security system of claim 1, wherein the second monitoring system also includes a real time clock which operates continuously whereby door openings are time stamped.

9. The security system of claim 1, wherein communication means are also provided between the second monitoring means and the first monitoring means whereby information of door openings detected while the first monitoring means is unpowered may be communicated to it upon reinstatement of power.

10. A slot machine having game playing means, control means and a security system for monitoring door openings, the security system including one or more door open detection devices, and first and second monitoring systems each connected to each of the one or more detection devices, the second monitoring system being arranged with battery power supply means and the first monitoring system being arranged to allow the second monitoring system to continue operating when power to the first monitoring system is interrupted.

11. The slot machine of claim 10 wherein the two monitoring systems each supply power to each of the door open detection devices via a pair of sharing diodes such that if power to one monitoring system is interrupted, power is still supplied by the other system without being loaded by the unpowered system.

12. The security system of claim 11, wherein communication means are also provided between the second monitoring means and the first monitoring means whereby information of door openings detected while the first monitoring means is unpowered may be communicated to it upon reinstatement of power.

13. The slot machine of claim 10, wherein the second monitoring system is arranged to operate intermittently at regular intervals, when operating from batteries, and returns to a low power mode between monitoring operations.

14. The slot machine of claim 10, wherein the second monitoring system also includes a real time clock which operates continuously whereby door openings are time stamped.

15. The security system of claim 10, wherein communication means are also provided between the second monitoring means and the first monitoring means whereby information of door openings detected while the first monitoring means is unpowered may be communicated to it upon reinstatement of power.

16. The slot machine of claim 15 wherein the second monitoring system is arranged to operate intermittently at regular intervals, when operating from batteries, and returns to a low power mode between monitoring operations.

17. The slot machine of claim 16 wherein the second monitoring system also includes a real time clock which operates continuously whereby door openings are time stamped.

* * * * *